US005519428A

United States Patent [19]

Van Peteghem

[11] Patent Number: 5,519,428

[45] Date of Patent: May 21, 1996

[54] THERMAL IMAGE-RECORDING APPARATUS WITH SENSOR MEANS FOR SENSING THE TYPE OF PRINT SHEET

[75] Inventor: Willy Van Peteghem, Edegem, Belgium

[73] Assignee: AGFA-Gevaert N. V., Mortsel, Belgium

[21] Appl. No.: 160,679

[22] Filed: Dec. 2, 1993

[30] Foreign Application Priority Data

Dec. 14, 1992 [EP] European Pat. Off. ..... 92203895

[51] Int. Cl.[6] ..... B41J 13/00

[52] U.S. Cl. ..... 347/215; 347/218

[58] Field of Search ..... 347/218, 193, 347/104, 164, 262, 215, 14; 400/74, 708; 271/122, 902, 225

[56] References Cited

U.S. PATENT DOCUMENTS

| | | | |
|---|---|---|---|
| 4,795,999 | 1/1989 | Takahashi et al. | 400/708 |
| 4,900,173 | 2/1990 | Okamura | 400/708 |
| 4,928,951 | 5/1990 | Fukui | 271/122 |
| 5,029,837 | 7/1991 | Uchiyama | 271/122 |
| 5,039,080 | 8/1991 | Kato et al. | 271/122 |
| 5,220,352 | 6/1993 | Yamamoto et al. | 400/708 |

FOREIGN PATENT DOCUMENTS

| | | | |
|---|---|---|---|
| 222860 | 9/1987 | Japan | 400/708 |
| 227271 | 9/1990 | Japan | 400/708 |
| 292968 | 10/1992 | Japan | 400/708 |

*Primary Examiner*—N. V. Le
*Attorney, Agent, or Firm*—William J. Daniel

[57] ABSTRACT

Thermal image recording apparatus which can be set for recording on any of a plurality of different types of recording sheets, e.g. opaque or transparent, and wherein a sheet is fed by a suitable sheet feeder, preferably a rotatably drive sheet feeding rollers, from a supply a cassette or other supply source to a printing head for recording thereon, has a sensor for detecting the type of recording sheet used for the recording and for generating a control signal which is effective in the event a given sheet sensed by said sensor is of a type different from the type for which the apparatus is set, to disable the sheet feeding rollers from further feeding of the sheet to the printing head. Preferably, in the event of a mis-match between the type of sheet being fed and the machine setting, the direction of the sheet feeder is reversed and the mis-matched sheet is returned to its supply cassette. The cassette can then be replaced with a cassette with the proper type of sheets or the machine setting altered to correspond to the type of sheet actually in the supply cassette.

7 Claims, 4 Drawing Sheets

THERMAL IMAGE-RECORDING APPARATUS WITH SENSOR MEANS FOR SENSING THE TYPE OF PRINT SHEET

BACKGROUND OF THE INVENTION

Field of the Invention

The present invention relates to a thermal image recording apparatus which comprises a thermal print head.

In the thermal printing process, a dye-bearing donor ribbon is brought into contact with a dye-receiving print sheet at a print zone. Thermal printing is effected by contacting the donor ribbon which is advanced usually in step-wise fashion in a given direction, e.g. from a supply spool to a take-up spool, with a multi-element print head which spans the ribbon in a direction transverse to the direction of ribbon travel. The print head typically comprises a linear array of closely spaced resistive heating elements, each being. independently addressable by an applied voltage to heat that portion of the donor ribbon directly opposite and thereby cause dye to transfer from the ribbon to the print sheet. To maintain intimate contact between ribbon and print sheet during this printing operation, the donor ribbon and print sheet are partially wrapped over the surface of a rotatably driven print drum. The print drum is usually driven by a precision stepper motor to maintain precise synchronisation with the printing of information on the print sheet, whereas the take-up spool is rotatably driven by a far less expensive DC motor, its function being simply to collect expended donor ribbon. The donor ribbon is supplied by a rotatably mounted supply spool, and a clutching arrangement is used to control the drag on the ribbon by the supply spool so as to prevent free-wheeling of the supply spool under the influence of the take-up spool motor. In colour thermal printers, the donor web usually comprises patches of cyan, yellow and magenta dyes in a repeating series, and the print-receiving sheet is passed three times through the print zone to receive a full-colour image, The printing process described hereinbefore can be used for producing opaque as well as transparent prints. The former are prints on white or coloured paper that are intended for direct reading, whereas the latter are mostly so-called overhead projection prints intended for optical projection on a screen.

Each of the two types of print-receiving sheets requires a particular setting of the thermal image-recording apparatus.. For instance, a transparent print-receiving sheet requires the use of a dye-bearing ribbon with a higher dye content than the one which is required for printing on opaque sheets. This is due to the fact that light passes twice through the coloured image layer on an opaque sheet whereas in a transparent sheet it passes only once.

Further, there are a number of adjustments on the image recording apparatus that also depend on the type of print-receiving sheets used. One such adjustment relates to a drive control capable of controlling application energy given to heater elements in the thermal head on the basis of not only history information of a given heater element but also print information including print history information of heater elements adjacent to the present heater element. A print information-processing is carried out based on the print history information of the given heater element, the print history information of the adjacent heater elements, and the print history information of the preceeding and two times before print information of the adjacent heater elements.

In another adjustment, image data is extracted at a certain interval, and the heating resistor elements of the print head are supplied with electric energy corresponding to a density specified by the image data so as to correspond to the data extraction interval. The image data is extracted at an interval amounting to at least one single pixel out of the image data fed from an external device in the main scanning direction so as to prevent thermal interference with the neighbouring heating resistor elements, so that the heating resistor elements are operated accurately with respect to such electric energy so as to form a dot larger than the dot specified by the highest density of the inputted image data. As a result, density can be expressed in a high number of gradations.

All these and still other adjustments determine a given setting of the apparatus for a given type of print-receiving sheet and a given type of dye-bearing ribbon, and it will be understood that if an operator changes the cassette only of the apparatus that contains the print-receiving sheets for the production of another type of prints, while the other settings of the apparatus remain unaltered, the operation of the apparatus will not be satisfactory.

Also, an automatic adjustment of the apparatus by the reading of a code provided on the cassette with print-receiving sheets as practiced e.g. in the field of amateur photography for reading the film sensitivity on the casing of a film cassette and setting the camera accordingly cannot be used in this type of apparatus, since replacement of an opaque print-receiving material by a transparent one requires also replacement of the cassette for the dye-bearing ribbon.

SUMMARY OF THE INVENTION

1. Object of the Invention

It is an object of the invention to provide a thermal image-recording apparatus suited for producing images on opaque as well as on transparent print-receiving sheets, which apparatus is provided with means for preventing incorrect use, thus avoids waste of dye-bearing ribbon and/or of print-receiving material, as well as time.

2. Statement of the Invention

A thermal image recording apparatus which comprises a print head, a rotatably mounted print drum, rotatably mounted supply and take-up spools for a dye-bearing ribbon, a cassette for a stack of print-receiving sheets and sheet-feed means for removing a print-receiving sheet in timed sequence from this stack for feeding towards the print drum, is characterised thereby that said apparatus comprises sensor means for sensing the type of sheet taken from the stack of print-receiving sheets thereby to assess whether said sheet is a transparent or an opaque one, said sensor means being located at a position between said cassette and the print drum, said feed means being arranged for removing the top sheet of said stack and advancing it to a point where its leading margin is within the reach of the sensor means but out of reach of the print drum, means for determining whether the setting of the apparatus corresponds with the type of removed sheet, and means for producing a control signal to interrupt the normal working of the apparatus if the removed sheet type does not correspond with the setting of the apparatus.

The term "setting of the apparatus" encompasses the electronic adjustments of the apparatus as well as the presence of a particular type of dye-bearing ribbon.

Although the sensing of the type of print-receiving sheets in the supply cassette can occur in different ways, a preferred technique in accordance with the present invention comprises the use of an optical sensor formed by a light source and an associated photosensor between which that lateral margin of a sheet can pass. Considering that the average optical density of a transparent sheet is 0.03 and of a paper sheet 1.5, it is clear that both types of sheets are easily distinguishable from each other in this way.

According to a further preferred embodiment of the invention the sheet feed means is arranged for reversible operation, and the control means controls said feed means such that if the setting of the apparatus does not correspond with the type of removed sheet, said sheet-feed means feeds a dispensed sheet back in the cassette. In this way the mistake of an operator is restored in the quickest way since he has simply to take out the cassette with the unsuited type of sheets and substitute a correct one. The alternative is to set the apparatus in accordance with the type of sheets introduced in the apparatus. The mentioned operation of the apparatus can be accompanied by a suitable warning signal indicating what is going wrong.

The apparatus according to the invention suitably comprises sheet separating means for separating double-fed sheets from each other, followed by at least one pressure roller pair for advancing a sheet towards the print drum.

BRIEF DESCRIPTION OF THE DRAWINGS

The invention will be described hereinafter by way of example with reference to the accompanying drawings wherein.

DETAILED DESCRIPTION OF THE INVENTION

Figure 1:
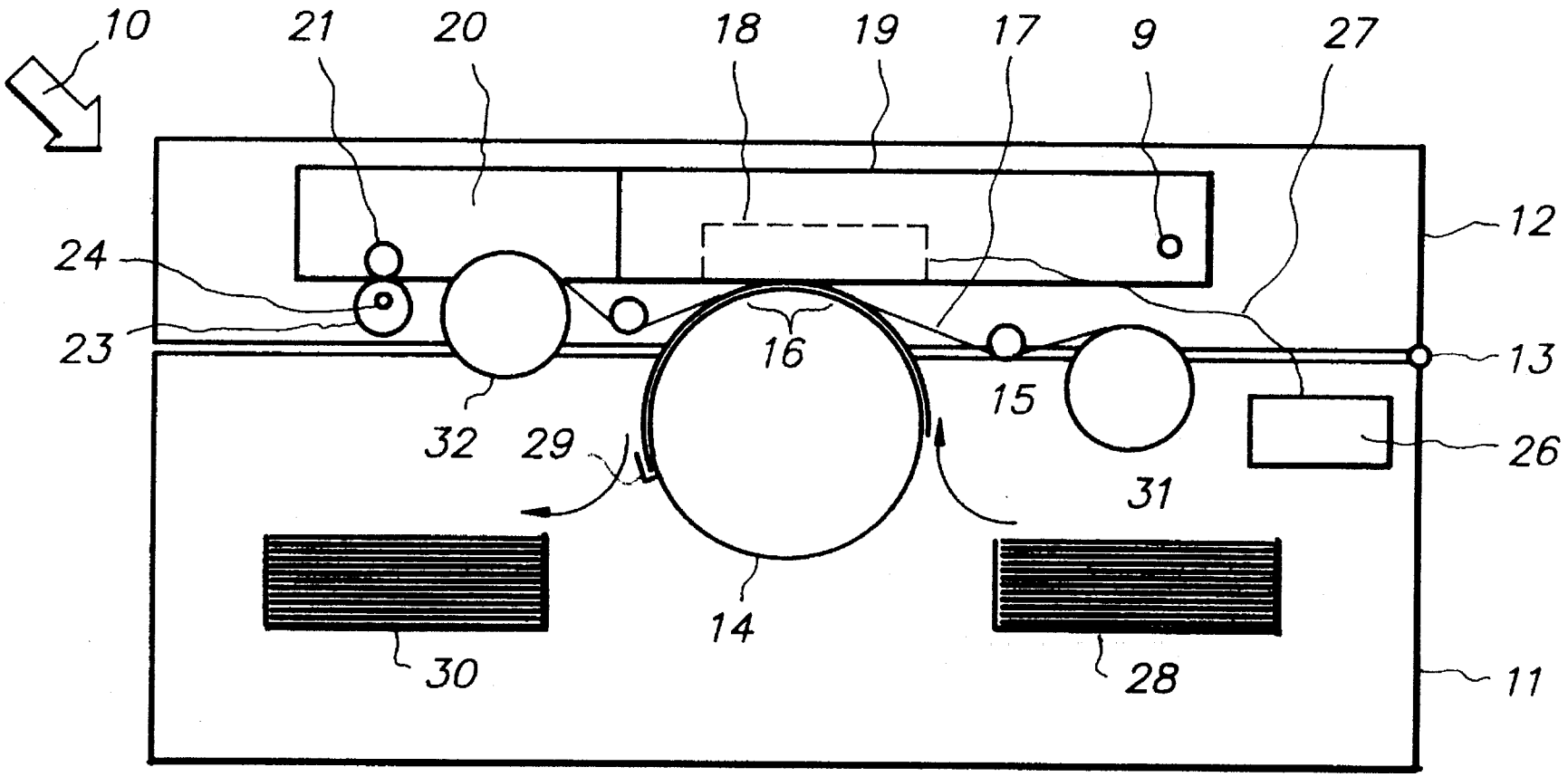
FIG. 1 is a diagrammatic representation of one embodiment of a thermal image-recording apparatus according to the present invention, the print head being in the operative position.

FIG. 1 shows a diagrammatic representation of one embodiment of a thermal image recording apparatus according to the present invention.

The apparatus is mounted in a housing 10 having a base 11 and a lid 12 hinged to the base at 13, and generally comprises a cylindrical print drum 14 which functions to support and transport a print-receiver sheet 15 through a print zone 16 where it receives thermally printed information.

Thermal printing is effected by advancing a dye-bearing donor ribbon 17 through the print zone between the print-receiver sheet 15 and a print head 18.

Figure 2:
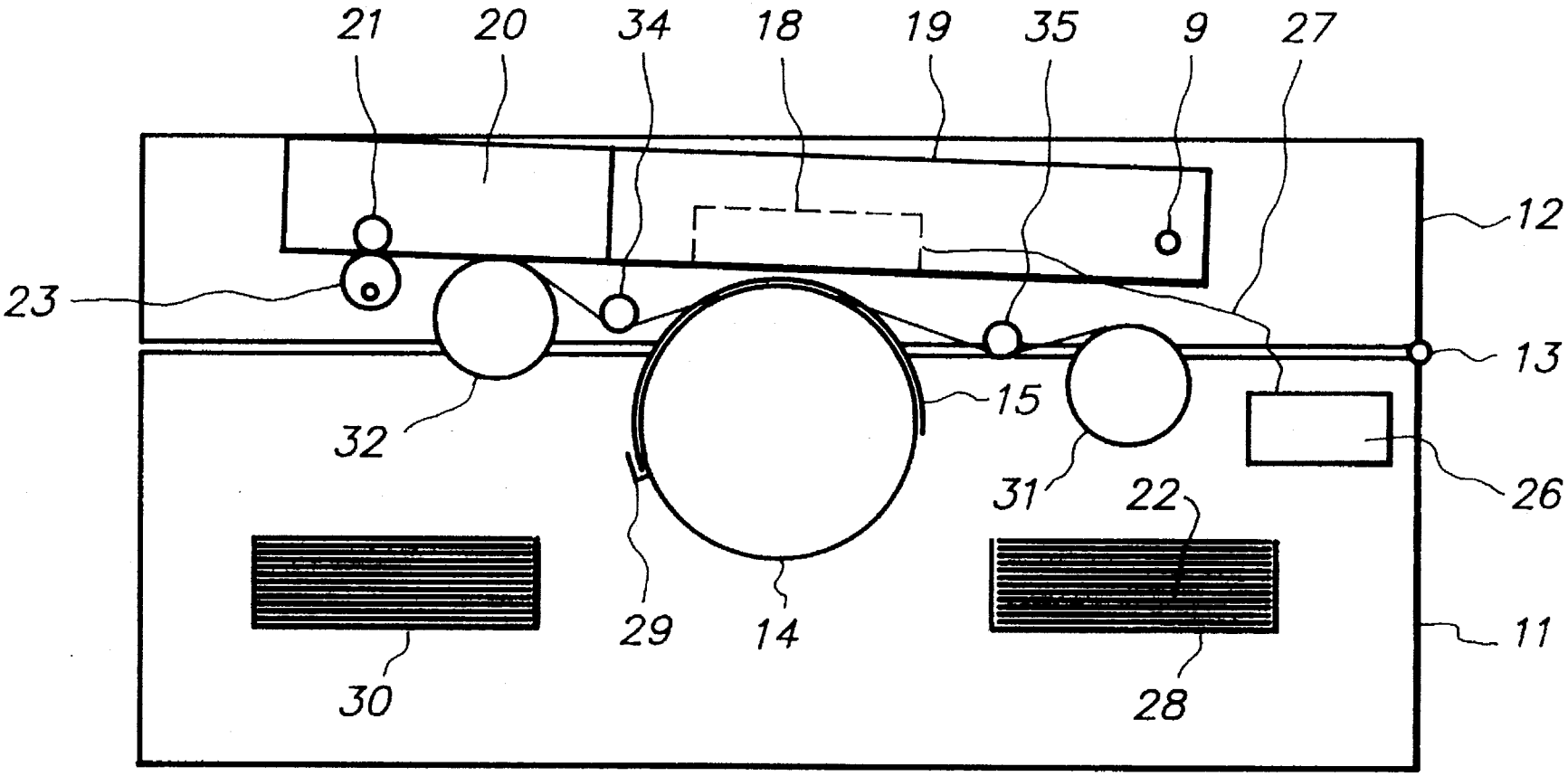
FIG. 2 shows the apparatus according to FIG. 1 with the print head in the inoperative position.

The print head is shown in broken lines and is mounted in a subhousing 19 mounted in lid 12 pivotable about a pin 9. The subhousing has two arms 20 spaced in parallel, which are interconnected by a rod 21. Rod 21 rests on a cam 23 mounted on shaft 24 equally mounted with its driving motor (not shown) in lid 12. Rotation of the cam brings the print head from its print position in which it presses against the print drum and the media therebetween (see FIG. 1), into a non-printing position in which the print head is spaced from the print drum (see FIG. 2).

Print head 18 spans the print drum and is of conventional design, comprising a linear array 25 (see FIG. 3) of closely spaced resistive elements, each being independently addressable with image information by an applied voltage provided by a microprocessor 26 connected via cable 27. As each resistive element is addressed, it heats that portion of the donor ribbon directly opposite, thereby causing dye to transfer from the donor ribbon to the print-receiver sheet. The print-receiver sheets 22 are fed to the drum from a cassette 28 and are clamped to the drum by a suitable clamping mechanism 29. After the thermal image has been produced, the clamping mechanism releases the print-receiver sheet allowing it to enter an output tray 30, which has been illustrated within the housing but which may be located in front of the apparatus as well. Print drum 14 is rotatably driven by a precision stepper motor, which in turn is controlled by microprocessor 26. The microprocessor also functions to control the position of the subhousing via cam 23, so as to move print head 18 to its non-printing position to allow passage of the clamping mechanism through the print zone. More details about the mounting of the print head in the subhousing can be found in our co-pending EP application No. . . . entitled: "A thermal image-recording apparatus", filed on even day herewith.

The dye-bearing donor ribbon, 17 is fed from a supply spool 31 to a take-up spool 32 driven by a suitable motor. Both spools can be fitted in a disposable cassette for ease of handling, as known in the art.

Figure 3:
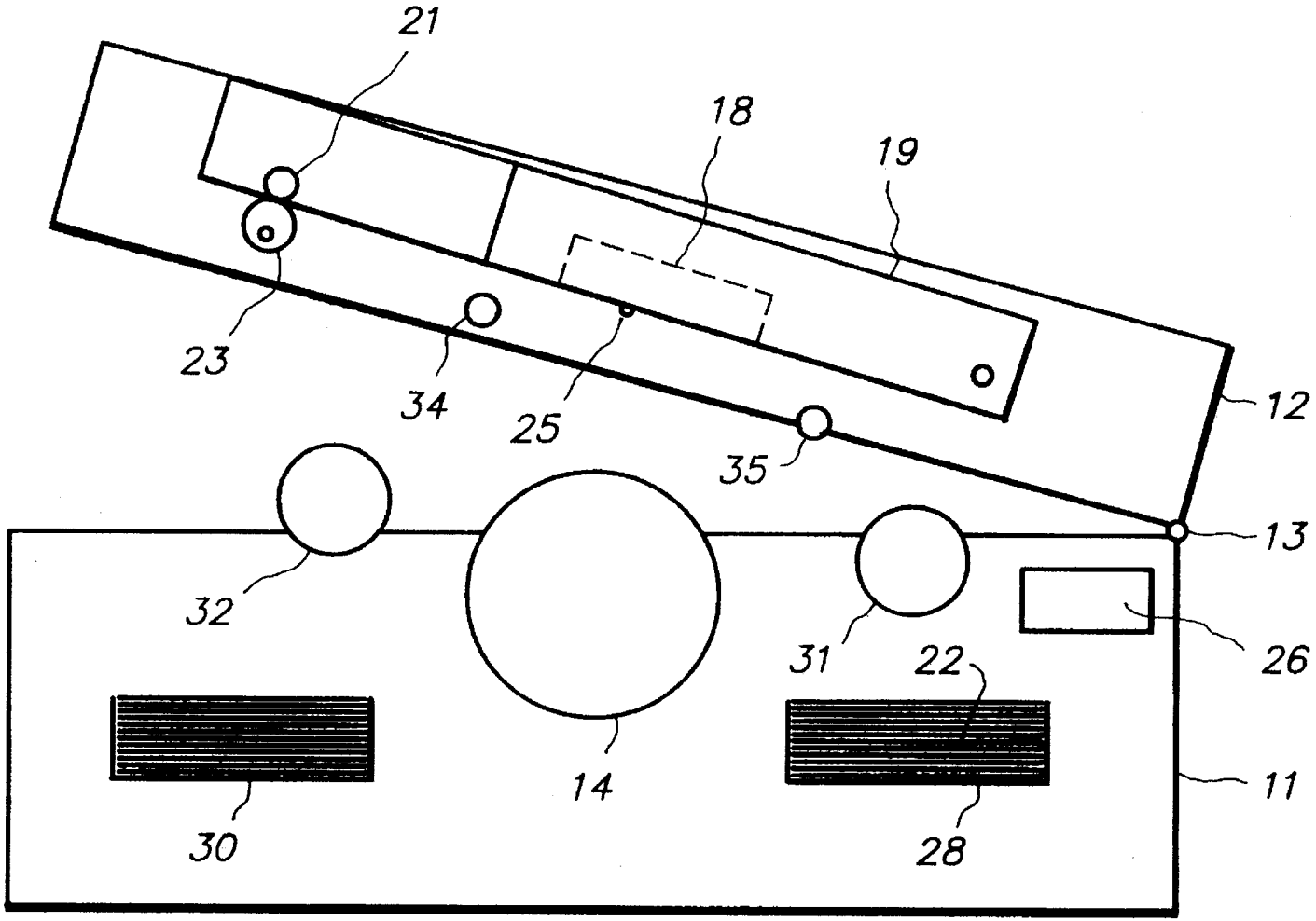
FIG. 3 shows the apparatus according to FIG. 1 with the lid opened.

FIG. 3 shows the apparatus with lid 12 opened, the print head being brought into its non-printing position by appropriate rotation of cam 23. This figure also shows that rollers 34 and 35 controlling the path of the dye-donor ribbon move together with lid 12.

Figure 4:
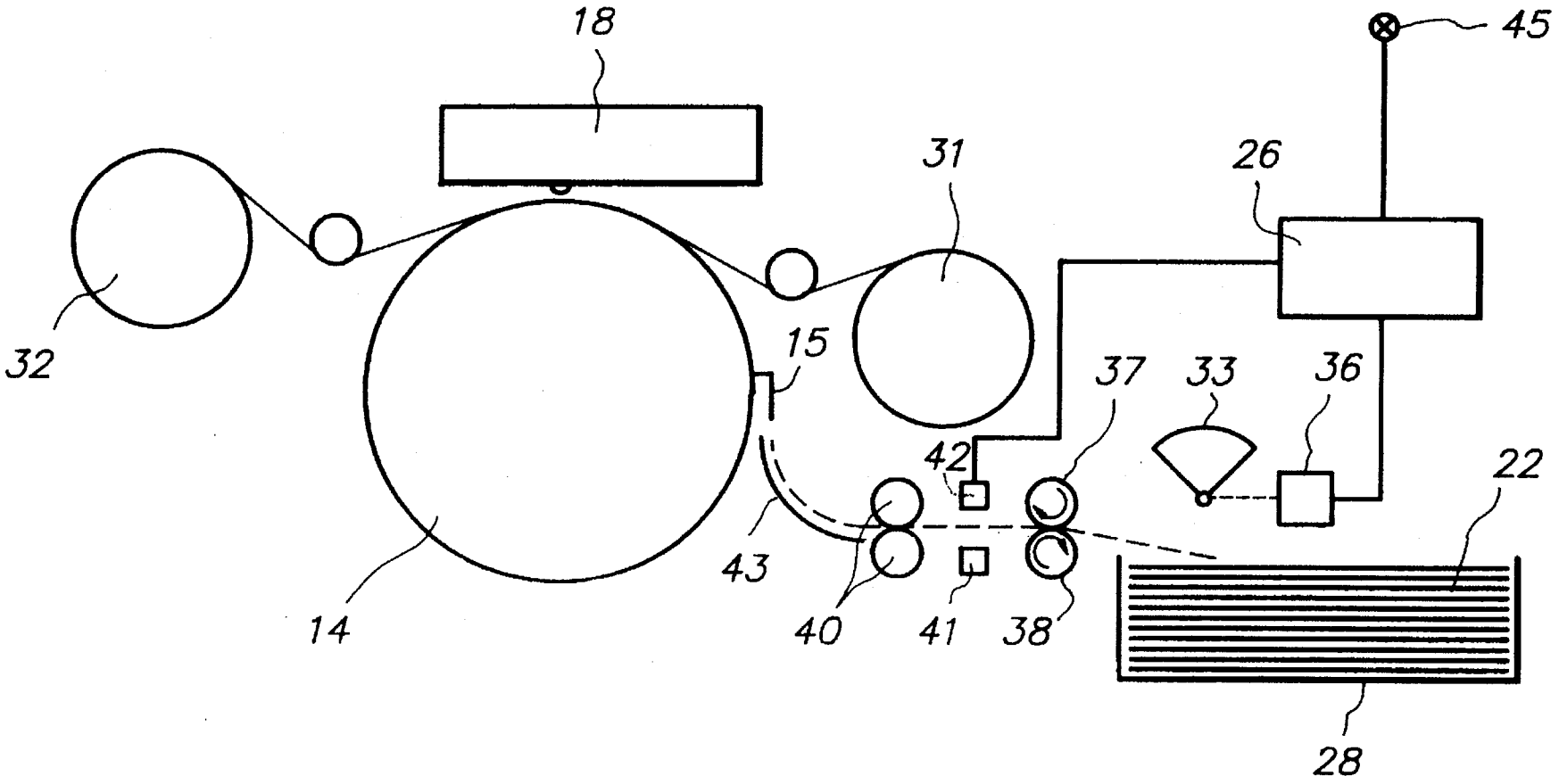
FIG. 4 is an enlarged cross-sectional view of the sensor arrangement for sensing the type of print-receiving sheets.

Referring to FIG. 4 which shows an enlarged detail of the apparatus, the feed mechanism for providing print drum 14 with the top sheet of a stack of print-receiving sheets 22 loaded in cassette 28 comprises a dispenser 33 in the form of a segment of rubber or like material rotatable about a horizontal axis and drivable by motor 36 capable of rotating the dispenser in either forward or reverse direction under the control of microprocessor 26.

As dispenser 33 advances the top sheet from the stack of sheets 22, the sheet passes between two rollers 37,38 rotating in equal directions and being arranged so that in case two, or even more, sheets are fed at a time, the upper sheet only is advanced whereas the lower sheets are returned to cassette 28. The optical density of the sheet is measured by sensing means comprising light source 41 and optical sensor 42 that can suitably be arranged to sense a lateral margin of the sheet. The light source can be any type of source such as an incandescent lamp or a LED, the radiation of which is occasionally brought in the vicinity of the sheet via an optic fiber. Sensing can occur while the sheet is temporarily at a standstill, at normal transport velocity, or at shortly reduced speed of the sheet. If the type of sheet, e.g. a paper sheet, corresponds with the setting of the apparatus as explained hereinbefore, the rollers continue to rotate whereby the sheet is gripped by driven roller pair 40 and deflected by guide 43 towards the print drum 14 where its leading edge becomes gripped by clamp 15. The printing cycle starts by the energising of the respective elements of print head 18, and corresponding rotation of drum 14, followed by a second and a third rotation in case a colour print has to be made.

If the setting of the apparatus does not correspond with the type of print-receiving sheets 22 introduced in the apparatus, e.g. if the apparatus was set for operation with opaque sheets and if transparent print-receiving sheets are received from cassette 28, photocell 42 receives an increased amount of light indicative of a transparent sheet. The signal of cell 42 is compared in controller 26 with a pre-set signal for paper, and the resultant error signal causes a warning signal 45 to light, and preferably also an instantaneous reversal of the rotation of roller 37, and also of dispenser 33, which was still in engagement with the trailing end of the sheet, to pull the sheet back in cassette 28.

The operator can now replace the cassette by another one containing the correct type of print-receiving sheets and then restart the operation. The fact that the apparatus did not continue its first printing cycle which inevitably would have led to an unsatisfactory print but instantly returned an imposed print-receiving sheet, means a saving in time and also the avoidance of possible sheet jam caused by the use of a print-receiving sheet under improper conditions.

The apparatus according to the invention is not limited to the embodiment described hereinbefore. The cassette containing the supply and take-up spools for the dye-bearing ribbon need not necessarily be of a disposable type but could equally well be reloadable, as disclosed in our co-pending application Ser. No. 92 203 247.9, filed on Oct. 22, 1992, and entitled: "A dye ribbon package for use with a thermal printer and loading the reloadable cassette of a thermal printer with a dye ribbon from a dye ribbon package."

The sensor means can also be located just after instead of just before the sheet-driving roller pair 40.

I claim:

1. In a thermal image recording apparatus which comprises a thermal printhead adapted to be activated to generate heat according to a pattern of information, a printing support for supporting an image recording sheet in a recording position proximate to said printhead, rotatably mounted supply and take-up spools for advancing a dye-bearing ribbon between said printedhead and said printing support, dye being transferable from such ribbon to a image recording sheet in printing position when the printed is activated, an interchangeable cassette for a stack of recording sheets corresponding to any one of a plurality of different types of recording sheets, sheet feeding means for removing a recording sheet from said stack and feeding the same to said recording position in timed relation to the advance of said dye-bearing ribbon, and control means for controlling the activation of said printhead, said control means being adapted to be set according to the type of recording sheet on which said pattern of information is to be recorded, in combination, the improvement which comprises a sensor for detecting the type of a given sheet being fed by said sheet feeding means before said given sheet reaches said printing position and generating an output corresponding to the sheet type thus detected, comparator means for comparing said sensor output with the setting of the printhead control means and producing a control signal when said sensor output does not match the setting for the printhead control means, and control means for said sheet feeding means responsive to the control signal produced by said comparator means for disabling said sheet feeding means from further feeding of said given sheet to said printing position.

2. As thermal image recording apparatus according to claim 1, wherein said sensor is located at a point spaced from said printing position in the direction of said cassette a sufficient distance that the sensor is capable of detecting the type of said given sheet being fed before a leading edge of said given sheet reaches said printing position.

3. A thermal image-recording apparatus according to claim 1, wherein said sensor (42) is an optical sensor.

4. A thermal image recording apparatus which comprises a thermal printhead adapted to be activated to generate heat according to a pattern of information, a printing support for supporting an image recording sheet in a recording position proximate to said printhead, rotatably mounted supply and take-up spools for advancing a dye-bearing ribbon between said printhead and said printing support and transferring dye therefrom to a image recording sheet in printing position when said printhead is activated, and interchangeable cassette for a stack of recording sheets corresponding to any one of a plurality of different types or recording sheets, sheet feeding means for removing a recording sheet from said stack and feeding the same to said recording position in timed relation to the advance of said dye-bearing ribbon, and control means for controlling the activation of said printhead, said control means being adapted to be set according to the type of recording sheet on which said pattern of information is to be recorded, in combination, the improvement wherein said sheet feeding means is adapted to be reversed in its direction of feeding of said sheet and which comprises a sensor for detecting the type of a given sheet being fed by said sheet feeding means before said given sheet reaches said printing position and generating an output corresponding to the sheet type thus detected, comparator means for comparing the sensor sheet output with the setting of the printhead control means and producing a control signal when said sensor output does not match the setting for the printhead control means, and control means for said sheet feeding means responsive to the control signal produced by said comparator means for reversing the direction of feeding of said sheet feeding means to return the given sheet to said cassette and for discontinuing further operation of the apparatus.

5. A thermal image recording apparatus according to claim 4, wherein said sensor is disposed in proximity to said sheet feeding means and is adapted to carry out a sensing operation when the sheet being sensed is only partially removed from said cassette, to thereby facilitate return of such sheet to the supply cassette.

6. A thermal image recording apparatus according to claim 4 wherein said sheet feeding means comprises a first pair of feed rollers which are rotatively driven in the same direction of rotation with the rollers of said pair being separated from one another to prevent the feeding of more than one sheet at a time from said cassette.

7. A thermal image recording apparatus according to claim 6 wherein said sheet feeding means further comprises a second pair of feed rollers adapted to grip a sheet delivered by said first pair of feed rollers and forward the gripped sheet to said printing position.

* * * * *